United States Patent [19]

Fox

[11] 4,186,921

[45] Feb. 5, 1980

[54] METHOD OF MAKING A TETHERED BALL APPARATUS

[76] Inventor: Daniel W. Fox, 202 E. Sharon, Phoenix, Ariz. 85022

[21] Appl. No.: 898,218

[22] Filed: Apr. 18, 1978

[51] Int. Cl.[2] ..... A63B 69/40

[52] U.S. Cl. ..... 273/26 E; 273/58 C; 29/428; 24/115 H

[58] Field of Search ..... 273/26 E, 200 R, 200 A, 273/58 C, 58 B, 58 E, 58 D, 95 A, 97 R, 185 C, 196, 208, 44, 45; 272/75; 29/428, 429; 24/115 H, 115 K, 122.3, 122.6

[56] References Cited

U.S. PATENT DOCUMENTS

| | | | |
|---|---|---|---|
| 268,931 | 12/1882 | Pohley | 272/75 |
| 439,297 | 10/1890 | Heyder | 273/95 A |
| 1,014,233 | 1/1912 | Kip | 273/200 R |
| 1,538,720 | 5/1925 | Mercer | 273/95 A |
| 2,948,532 | 8/1960 | Tepsen | 273/58 C |
| 2,961,241 | 11/1960 | Borg | 273/200 |
| 3,081,493 | 3/1963 | Olsen et al. | 273/58 C |
| 4,022,476 | 5/1977 | Barton | 273/58 C |

FOREIGN PATENT DOCUMENTS

| | | | |
|---|---|---|---|
| 1186571 | 10/1969 | United Kingdom | 273/29 R |

*Primary Examiner*—Richard C. Pinkham
*Assistant Examiner*—T. Brown
*Attorney, Agent, or Firm*—Clarence A. O'Brien; Harvey B. Jacobson

[57] ABSTRACT

Methods are disclosed of forming a tethered ball practice apparatus by attaching one end of a hollow braided tether line to a hollow perforated ball and the other end of the line to a handle. One end of the tether line is passed throug h a hole in the ball and then passed through a short length of plastic sleeve, the sleeve having been previously placed in the interior of the ball by insertion through an opening. After insertion through the sleeve, a loop is formed in the line by turning back and inserting the end thereof into an opening along the braided line and secured therein, the sleeve being included within the loop such that the loop and sleeve cannot be pulled through the hole when the apparatus is used.

6 Claims, 4 Drawing Figures

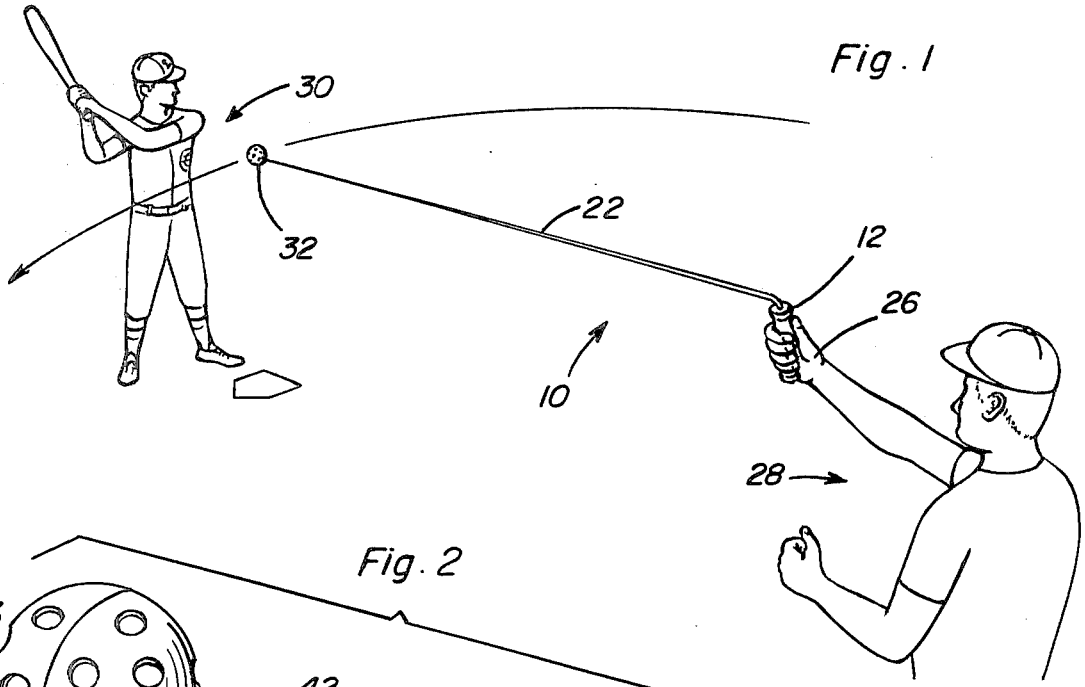
Fig. 1
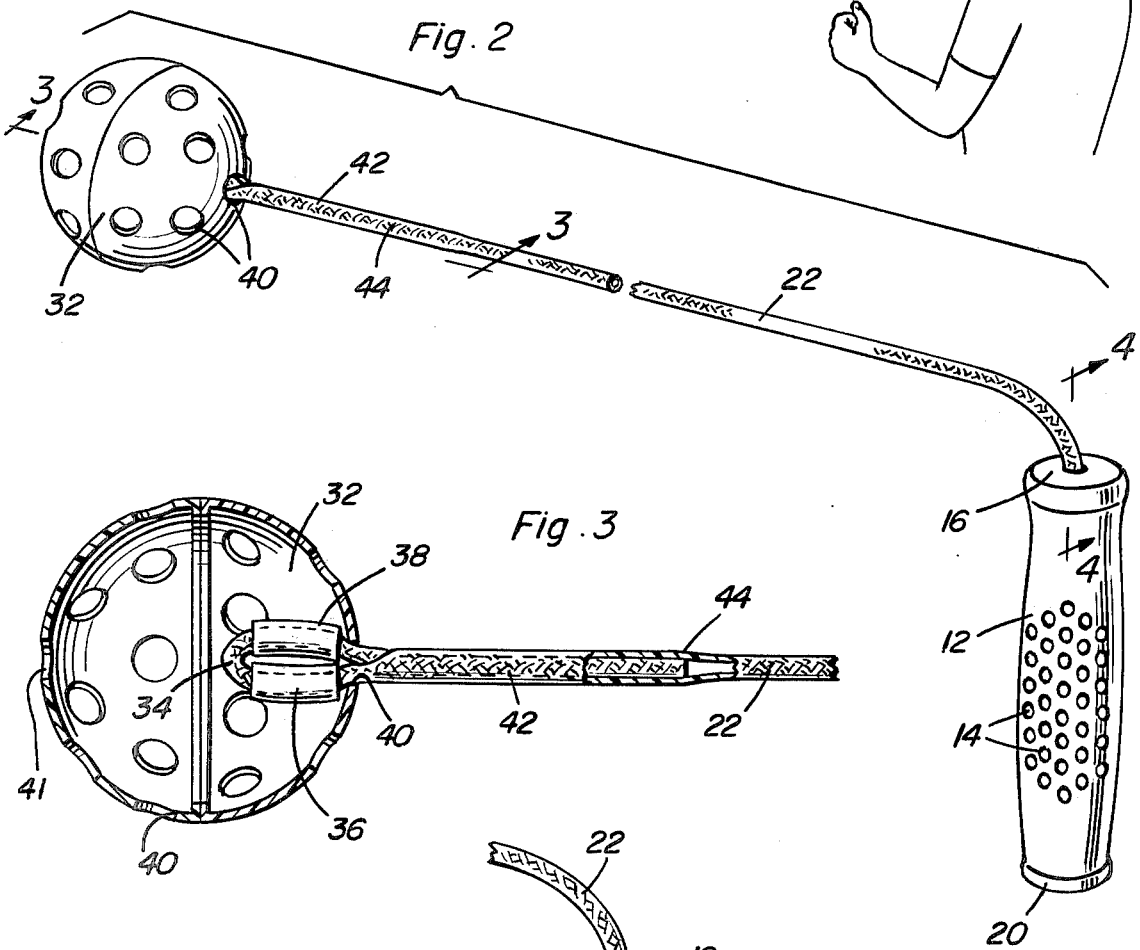
Fig. 2
Fig. 3
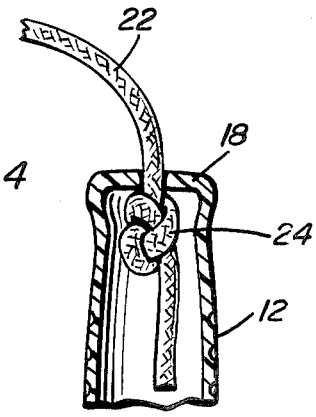
Fig. 4

METHOD OF MAKING A TETHERED BALL APPARATUS

BACKGROUND OF THE INVENTION

1. Field of the Invention

The invention relates to an athletic improvement device and method of making same, more particularly, to a tethered ball batting practice device operated by a pitcher for baseball batting practice by a batter.

2. Description of the Prior Art

Batting practice devices and other tethered ball recreational devices are known, such as the batting practice device described in U.S. Pat. No. 3,907,287 to Fox et al showing a perforated ball secured to one end of a tether line, the opposite end of which is spring-attached to a handle through pivoting and rotating members. The present invention represents a considerable improvement upon the device disclosed in U.S. Pat. No. 3,907,287 for reasons described below.

Other U.S. patents exemplifying such devices are: U.S. Pat. Nos: 1,465,806-Aug. 21, 1923-Chester; 2,496,795-Feb. 7, 1950-Johnson;

2,765,170-Oct. 2, 1956-Brown; 2,929,632-Mar. 22, 1960-Moffatt; 2,942,883-June 28, 1960-Moore; 3,051,491-Aug. 28, 1962-Cabot; 3,186,711-June 1, 1965-Morrow; 3,351,343-Nov. 7, 1967-Papp; 3,531,115-Sept. 29, 1970-Alexander; 3,601,398-Aug. 24, 1971-Brochman; 3,626,502-Dec. 7, 1971-Well; 3,637,209-Jan. 25, 1972-Raut; 3,731,925-May 8, 1973-Caldwell; 3,764,140-Oct. 9, 1973-Lotfy; and British Pat. No. 329,184-May 15, 1930-Bulley.

None of these examples of prior art devices shows the structure including the means of attachment hereinafter described for the present invention.

SUMMARY OF THE INVENTION

The batting practice device of Fox et al, disclosed in U.S. Pat. 3,907,287, provides batting practice activity for a batter when the device is rotated by the operator. This device, however, requires assembly of many components, involving, inter alia, the steps of looping one end of a tether line, forming a hand grip member, making a metal strap means, drilling the strap means, tightening the strap to a wooden insert through a wood screw, applying heat to a plastic tethering line and expanding the tip of the tethering line through a grommet fastened to the ball. In addition, the possibility exists for inconvenient disassembly of parts, for example, unfastening of the spring means from the loop portion of the tether line connected to the spring. Since such disassembly is most likely to occur in operation of the device after striking of the ball by the batter, the possibility exists of injury to bystanders, and particularly to the pitcher. Similar hazards exist for other practice devices disclosed in the prior art, with the degree of hazard being generally greatest with devices having a greater number of component parts.

Accordingly, it is an object of the present invention to provide a tethered ball batting practice device which is safe in operation.

Another object of the invention is to provide a batting practice device which is economically manufactured.

Still another object of the invention is to provide a batting practice device which can be manufactured from a minimum number of components.

Yet another object of the invention is to provide a batting practice device which can be manufactured with simple and common hand tools and requires no specially designed equipment or tools.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of two athletes using the tethered ball batting practice device of the present invention.

FIG. 2 is a similar view but on an enlarged scale.

FIG. 3 is a partly sectional view taken generally along section line 3—3 on FIG. 2 detailing the connection between the ball and tether line of the device.

FIG. 4 is an enlarged, partly sectional view taken generally along section line 4—4 on FIG. 2 detailing the connection between the handle and tether line of the device.

DETAILED DESCRIPTION OF THE INVENTION

The over-all tethered ball batting practice device of the present invention is designated by reference numeral 10. Handle 12 is of hollow unitary construction, having indentations 14 to provide a secure grip. Handle 12 has upper extremity 16 which forms neck 18 narrower than lower extremity 20. Tether line 22 can be passed through upper extremity 16 through hollow handle 12 and out lower extremity 20, and is knotted near its end. When tether line 22 is pulled outwardly through neck 18 of handle 12, knot 24 is prevented from passing through neck 18 by the relatively narrow diameter of the neck, as can be seen from FIG. 4. Handle 12 is of unitary construction, and is preferably made from a plastic composition of a thickness sufficient to impart sufficient rigidity to prevent crushing or bending of handle 12 during use, yet of a thickness sufficient to provide resiliency to assist in maintaining a secure grip by the operating hand 26 of pitcher 28, such resiliency of handle 12 serving to cushion any shock which may occur when batter 30 hits ball 32. Ball 32 is hollow, generally rigid in construction, and has a plurality of holes through its surface. Tether line 22 is made up of a plurality of strands which are woven or braided, thus imparting some resilience to tether line 22, and further cushioning any shock transmitted to pitcher 28 when batter 30 hits ball 32. Although many substitutes and equivalents well known to those skilled in the art are available, materials of construction which can be successfully used to practice the invention are nylon or polypropylene (preferably nylon) for plastic tether line 22; polyethylene for ball 32; and polyvinyl chloride for handle 12.

Ball 32 is secured to tether line 22 through loop 34, within ball 32, tether line 22 passing through one of the holes 40 in ball 32. Plastic sleeves 36 and 38, located along the circumference of loop 34, serve to prevent loop 34 from being pulled outwardly through hole 40 of ball 32. Assembly of loop 34 with associated plastic sleeves 36 and 38 is most conveniently accomplished by the following technique. Ball 32 is sectioned into equal sized hemispheres. A free end of tether line 22 remote from handle 12 is placed through a hole in one such hemisphere in the convex to concave direction. The free end of tether line 22 is inserted through sleeve 36, and then through sleeve 38. The free end of tether line 22 is looped back to form a loop containing both sleeves 36 and 38, and the free end then is inserted through an opening made in hollow tether line 22 a short distance from the end. Such insertion is facilitated by a pencil-like tool whose construction and operation is conventional and well known to those skilled in the art. Sliding of the free end within hollow tether line 22 in the direction of handle 12, finally terminating at taper 44, reduces the diameter of the loop to that of loop 34 in FIG. 3. The sectioned hemispheres are joined by conventional means to form ball 32 containing loop 34. The bulk of sleeves 36 and 38, together with their coaction, insures a reliably secure attachment of tether line 22 to ball 32, with no possibility of outward movement of loop 34 through hole 40 of ball 32.

A second means for fastening line 22 to ball 32, involving no sectioning of ball 32, and later joining of the sections after forming the loop, is the following. A free end of tether line 22 remote from handle 12 is passed through a hole 40 of ball 32, through the interior of the ball and out a second hole 41 disposed opposite that of the first hole. Line 22 is then inserted through sleeve 36 and then through sleeve 38, which sleeves are then passed through hole 41 into the interior of ball 32, and line 22 is then turned back and inserted sequentially through holes 41 and 40, and being thereby looped back to form a loop containing sleeves 36 and 38, with the free end inserted through an opening made in hollow tether line 22, such insertion being facilitated by the pencil-like tool referred to above. The diameter of loop formed is sufficient to permit drawing of the loop and associated sleeves into the interior of the ball, with no coaction of sleeves 36 and 38. However, the loop is tightened and its diameter reduced while the sleeves 36 and 38 and corresponding portions of the loop are interiorly of the ball by sliding of the free end within hollow tether line 22 in the direction of handle 12, finally forming taper 44 and reducing the diameter of the loop to that of loop 34 in FIG. 3. Coaction of sleeves 36 and 38 insures a reliably secure attachment, as in the first method of assembly described above.

Yet a third method of assembly of the attachment means without sectioning of the ball 32 into hemispheres, is the following. The free end of tether line 22 remote from handle 12 is inserted through hole 40 of ball 32, pushing cylinder 36 through another of the holes in ball 32 and feeding the free end of tether line 22 through sleeve 36 inside ball 32 by manipulation through the holes in ball 32. Sleeve 38 is then pushed inside ball 32, and the end of tether line 22 similarly inserted through sleeve 38. The ends of tether line 22 are then pulled back through hole 40 in ball 32. These strands can then be inserted into tether line 22, forming a thickened segment 42 which tapers back at taper 44 to the ordinary thickness of tether line 22.

An important feature of the invention associated with the simple, lightweight connecting means of the present invention is the degree of safety to bystanders and to the operators of the device. Ball 32, even when travelling at high speeds imparted by batter 30, carries relatively little momentum to a bystander or player who might be struck. Furthermore, no metallic parts which could pose a hazard of injury are present in the ball or in the handle assembly.

In use, and as illustrated in FIG. 1, pitcher 28 rotates perforated ball 32 at the end of tethering means 22 around the top of his head, and batter 30 swings at perforated ball 32 as it crosses plate 46. By combining appropriate arm and wrist motions, the pitcher can impart to ball 32 motions simulating those achieved by skilled baseball pitchers, such as "curve", "dip", and the like.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a method of making a tether ball practice device comprising a handle, an elongated hollow flexible braided plastic line connected to the handle and a hollow plastic ball connected to the end of the flexible line remote from the handle, whereby the ball and flexible line are swung in an orbital path about the handle so that the ball passes over a plate where a batter practices swinging at the ball as it passes over the plate, said ball being in the form of a substantially rigid plastic member having a plurality of holes therein, the improvement comprising the steps of attaching said ball to the end of said line remote from the handle by inserting a plastic sleeve through one of said holes in said ball, passing the end of said line remote from the handle through one of said holes and thence in sequence through said plastic sleeve, forming within said ball a closed loop by turning back and inserting the end of said line into an opening along said braided plastic line within said ball so as to include the plastic sleeve within the loop, securing said handle to the end of said line remote from said ball by providing a unitary resilient hollow plastic handle open at an upper extremity and a lower extremity with a neck at its upper extremity narrow than its lower extremity and wider than the diameter of said line, passing the end of said line through said upper extremity and thence through said lower extremity, and knotting said line projecting through said lower extremity to prevent the knotted line from being pulled outwardly through the neck.

2. The method of claim 1 where said handle is polyvinyl chloride, said ball is polyethylene, and said line is nylon.

3. In a method of making a tether ball practice device comprising a handle, an elongated flexible braided plastic line connected to the handle and a hollow plastic ball connected to the end of the flexible line remote from the handle, whereby the ball and flexible line are swung in an orbital path about the handle so that the ball passes over a plate where a batter practices swinging at the ball as it passes over the plate, said ball being in the form of a substantially rigid plastic member having a plurality of holes therein, the improvement comprising the steps of attaching said ball to the end of said line remote from the handle by passing the end of said line remote from the handle through a first and then a second of said holes, and thence through at least a pair of plastic sleeve, which sleeves are then passed through said second hole into the interior of said ball, said line then forming a closed loop by turning back said line and inserting the end thereof through said second hole and then said first hole, and inserting the end of said line into an opening along said braided plastic line outside said ball so as to include the plastic sleeve within the loop, passing said loop containing said sleeve into the interior of said ball, and sliding the end of said line inserted through said opening in the direction opposite said loop, securing said handle to the end of said line remote from said ball by providing a unitary resilient hollow plastic handle open at an upper extremity and a lower extremity with a neck at its upper extremity narrower than its lower extremity and wider than the diameter of said line, passing the end of said line remote from said ball through the upper extremity and thence through the lower extremity, and knotting the line projecting from said lower extremity near its end to prevent the knotted line from being pulled outwardly through the neck.

4. The method of claim 3 wherein said handle is polyvinyl chloride, said ball is polyethylene, and said line is nylon.

5. In the method of making a tether ball practice device comprising a handle, an elongated hollow flexible braided plastic line connected to the handle and a hollow plastic ball connected to the end of the flexible line remote from the handle, whereby the ball and flexible line are swung in an orbital path about the handle so that the ball passes over a plate where a batter practices swinging at the ball as it passes over the plate, said ball being in the form of a substantially rigid plastic member having a plurality of holes therein, the improvement comprising the steps of attaching said ball to the end of said line remote from the handle by sectioning said ball into two hemispherical sections, passing the end of said line remote from the handle through a hole in one of said sections in the convex to concave direction and thence in sequence through a plastic sleeve, forming a closed loop by turning back and inserting the end of said line into an opening along said braided plastic line so as to include the plastic sleeve within the loop, sliding of the end of said line within hollow line in the direction of the handle, securing the handle to the end of said line remote from said ball by providing a unitary resilient hollow plastic handle open at an upper extremity and a lower extremity with a neck at its upper extremity narrower than its lower extremity and wider than the diameter of said line, passing the end of said line remote from the ball through said upper extremity and thence through said lower extremity, and knotting the line projecting through said lower extremity to prevent the knotted line from being pulled outwardly through the neck.

6. The method of claim 5 wherein said handle is polyvinyl chloride, said ball is polyethylene, and said line is nylon.

* * * * *